US012433367B2

(12) United States Patent
Kita et al.

(10) Patent No.: US 12,433,367 B2
(45) Date of Patent: Oct. 7, 2025

(54) FABRIC FOR SHOE UPPER, SHOE UPPER, AND SHOE

(71) Applicant: MIZUNO CORPORATION, Osaka (JP)

(72) Inventors: Kenjiro Kita, Osaka (JP); Takao Oda, Osaka (JP); Mina Hayashiguchi, Osaka (JP); Takehiro Taguchi, Osaka (JP); Issei Tanaka, Osaka (JP)

(73) Assignee: Mizuno Corporation, Osaka (JP)

( * ) Notice: Subject to any disclaimer, the term of this patent is extended or adjusted under 35 U.S.C. 154(b) by 0 days.

(21) Appl. No.: 18/598,745

(22) Filed: Mar. 7, 2024

(65) Prior Publication Data

US 2024/0324717 A1 Oct. 3, 2024

(30) Foreign Application Priority Data

Mar. 31, 2023 (JP) ..... 2023-058820

(51) Int. Cl.
*A43B 9/08* (2006.01)
*A43B 3/00* (2022.01)

(52) U.S. Cl.
CPC ..... *A43B 9/08* (2013.01); *A43B 3/0036* (2013.01)

(58) Field of Classification Search
None
See application file for complete search history.

(56) References Cited

U.S. PATENT DOCUMENTS 4,571,960 A * 2/1986 Hursh ..... A41B 11/005 66/196
4,615,188 A * 10/1986 Hursh ..... A41B 11/02 66/196
4,843,844 A * 7/1989 Hursh ..... A41B 11/005 66/196
5,778,702 A * 7/1998 Wrightenberry ..... A41B 11/005 66/178 R (Continued)

FOREIGN PATENT DOCUMENTS

EP 2 716 176 4/2014
EP 2 716 177 4/2014

(Continued)

OTHER PUBLICATIONS

Office Action issued in corresponding Japanese Patent Application No. 2023-058820, Mar. 6, 2025, 10 pages w/ translation.

*Primary Examiner* — Jila M Mohandesi
(74) *Attorney, Agent, or Firm* — HSML P.C.

(57) ABSTRACT

A fabric used for a tongue-integrated upper of a shoe comprises a tubular fabric element. The tubular fabric element comprises a first sock part and a second sock part, the first sock part comprises a first foot and a first leg, the second sock part comprises a second foot and a second leg, with the first foot, the first leg, the second leg, and the second foot continuously formed in this order. The central axis of the first leg and the central axis of the second leg do not coincide with each other and are not parallel to each other, and when the first sock part and the second sock part are placed one on top of the other, the first sock part forms a first layer disposed on the foot side of an upper, and the second sock part forms a second layer disposed covering the first layer.

17 Claims, 10 Drawing Sheets

(56) References Cited

U.S. PATENT DOCUMENTS

| | | | | |
|---|---|---|---|---|
| 7,213,420 | B2 * | 5/2007 | Lynch | D04B 9/40 66/186 |
| 9,365,960 | B2 * | 6/2016 | Craig | D04B 1/26 |
| 9,675,134 | B2 * | 6/2017 | Kosui | A43B 23/0205 |
| 10,130,144 | B1 * | 11/2018 | Shiao | A43B 13/04 |
| 10,327,498 | B2 * | 6/2019 | Burch | A43B 23/0225 |
| 11,317,656 | B2 * | 5/2022 | Craig | D04B 1/26 |
| 11,445,779 | B2 * | 9/2022 | Hipp | A43B 7/125 |
| 2003/0089136 | A1 * | 5/2003 | Lynch | D04B 9/40 66/187 |
| 2010/0154256 | A1 | 6/2010 | Dua | |
| 2012/0318026 | A1 | 12/2012 | Dua et al. | |
| 2013/0318837 | A1 | 12/2013 | Dua et al. | |
| 2014/0230277 | A1 | 8/2014 | Dua et al. | |
| 2014/0245639 | A1 | 9/2014 | Dua et al. | |
| 2015/0208753 | A1 | 7/2015 | Dua et al. | |
| 2015/0342261 | A1 | 12/2015 | Boucher et al. | |
| 2017/0181501 | A1 * | 6/2017 | Gautier | A43B 23/088 |
| 2017/0224044 | A1 | 8/2017 | Dua et al. | |
| 2017/0224045 | A1 | 8/2017 | Dua et al. | |
| 2017/0224046 | A1 | 8/2017 | Dua et al. | |
| 2017/0231314 | A1 | 8/2017 | Dua et al. | |
| 2017/0311672 | A1 * | 11/2017 | Hipp | A43B 23/024 |
| 2018/0042340 | A1 * | 2/2018 | Kuo | D04B 1/108 |
| 2018/0206585 | A1 | 7/2018 | Cai et al. | |
| 2022/0408871 | A1 * | 12/2022 | Hipp | A43B 23/0245 |

FOREIGN PATENT DOCUMENTS

| | | |
|---|---|---|
| JP | 3127628 U | 12/2006 |
| JP | 2012-512698 | 6/2012 |
| JP | 2016-504106 | 2/2016 |
| WO | 2010/080182 | 7/2010 |

* cited by examiner

FABRIC FOR SHOE UPPER, SHOE UPPER, AND SHOE

FIELD OF THE INVENTION

The present invention relates to a fabric used for a shoe upper, a shoe upper, and a shoe, and more particularly to a fabric for a shoe upper. The fabric, when used for a tongue-integrated upper of a shoe, is capable of providing a shoe that is easy to put on, as well as a shoe upper and a shoe.

DESCRIPTION OF RELATED ART

Uppers of shoes, in particular, sports shoes, are generally made in a three-dimensional shape, so as to fit to the foot shape, by joining various materials and members through sewing or the like. However, sewing, bonding, or the like of different materials takes time and labor, and some contrivance is needed to deal with steps at joined portions and the like. In addition, there is growing demand for improvement not only in mere conforming fit to the foot shape but in adaptivity to changes in the foot shape and, in particular, softness of a portion that comes into contact with the foot surface. For these reasons, fabric uppers have been proposed. For example, JP 2012-512698T discloses an upper having a knitted component defining a tubular structure formed of unitary knit construction and a yarn having a configuration of a one-dimensional material, the yarn extending through at least a portion of a length of the tube. JP 2016-504106T discloses a fabric element including a sock foot, a first heel, a first upper, a second heel that is disposed at the top of the upper and is substantially symmetrical to the first heel with respect to a plane perpendicular to the axis of the upper, and a second upper that extends from the second heel, wherein the second heel is configured to cover the first heel when the second upper is pulled onto the sock foot.

JP 2012-512698T and JP 2016-504106T are examples of related art.

However, in JP 2012-512698T, a tongue is separated from the upper and covers the instep while partially overlapping the upper, and this results in poor contact between a foot and a shoe. In JP 2016-504106T, the fabric element is connected to a reinforcing structure, but when an upper is formed only of the fabric element without using a reinforcement, since the first heel and the second heel are substantially symmetrical to each other with respect to a plane perpendicular to the axis of the first upper, the heel side and the instep side of a wearing opening are at substantially the same horizontal level, which causes a problem in that it is difficult to adjust the ease of putting on and taking off a shoe.

To address the above-described problems, the present invention relates to a fabric for a shoe upper, the fabric, when used for a tongue-integrated upper of a shoe, being capable of providing a shoe whose supporting properties and ease of putting on and taking off the shoe can be easily adjusted and changed, as well as a shoe upper and a shoe.

SUMMARY OF THE INVENTION

The present invention relates to a fabric used for a tongue-integrated upper of a shoe, wherein the fabric comprises a tubular fabric element. The tubular fabric element comprises a first sock part and a second sock part. The first sock part comprises a first foot and a first leg, the second sock part comprises a second foot and a second leg, and the first foot, the first leg, the second leg, and the second foot are continuously formed in this order. A central axis of the first leg and a central axis of the second leg do not coincide with each other and are not parallel to each other, and when the first sock part is moved to be within the wall defining the second sock part, the first sock part forms a first layer disposed on a foot side of the upper, and the second sock part forms a second layer disposed to cover the first layer.

The present invention relates to a shoe upper including the above-described fabric for a shoe upper, wherein the upper has a first layer formed of the first sock part and disposed on a foot side, and a second layer formed of the second sock part and disposed covering the first layer. A heel side and an instep side of a wearing opening formed near a boundary between the first leg and the second leg are not at the same horizontal level.

The present invention relates to a shoe in which the above-described shoe upper and a sole are formed as a single body.

According to one or more embodiments of the present invention, the present invention relates to a fabric for a shoe upper. The fabric, when used for a tongue-integrated upper of a shoe, is capable of providing a shoe whose supporting properties and ease of putting on and taking off the shoe can be easily adjusted and changed, as well as a shoe upper and a shoe.

DETAILED DESCRIPTION OF THE INVENTION

Figure 1:
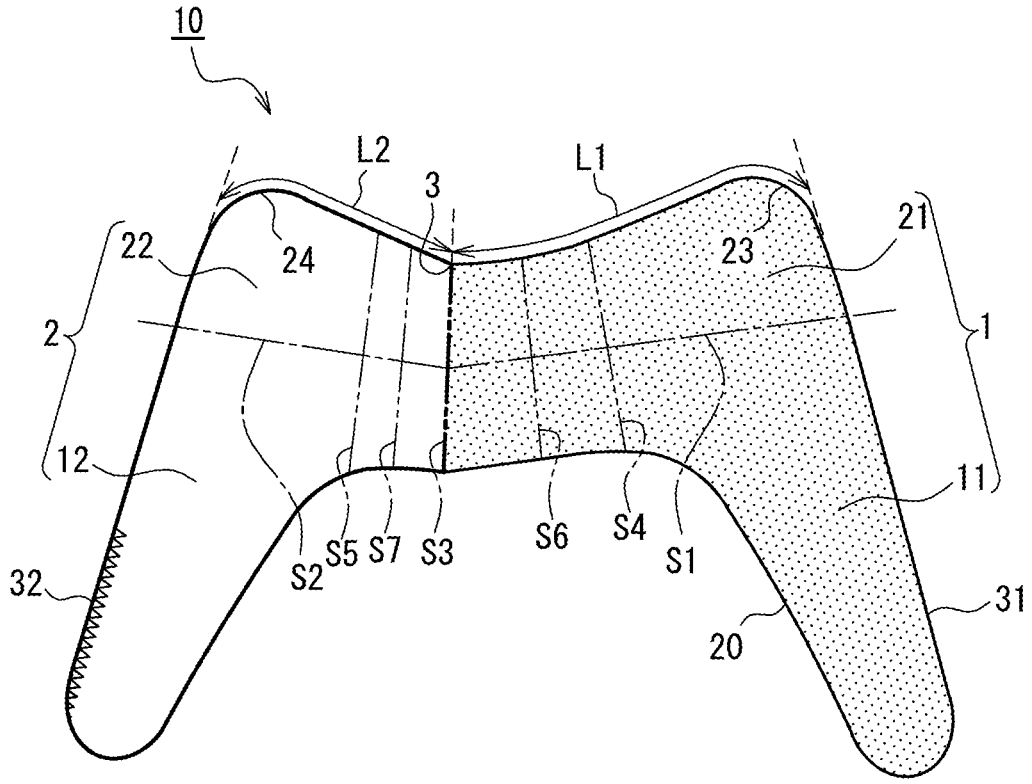
FIG. 1 is a schematic view showing a state in which a fabric according to an embodiment of the present invention is laid flat such that a heel of a first sock part and a heel of a second sock part are respectively disposed at opposite lateral side ends on the upper side.

The inventors of the present application have conducted in-depth research to improve the ease of putting on a tongue-integrated upper. As a result, the inventors found that, if a tubular fabric element, including a first sock part that comprises a first foot and a first leg and a second sock part that comprises a second foot and a second leg, is formed such that the central axes of the continuously formed first leg and second leg do not coincide with each other and are not parallel to each other. When the first sock part forms a first layer disposed on a foot side of an upper and the second sock part forms a second layer disposed covering the first layer, a heel side and an instep side of a wearing opening are not at the same horizontal level, making it easy to adjust and change the supporting properties and the ease of putting on and taking off.

Specifically, when the heel side of the wearing opening is at a higher level than the instep side thereof, a shoe that is less likely to come off and also has improved ankle holding properties can be obtained. On the other hand, when the heel side of the wearing opening is at a lower level than the instep side thereof, a shoe that allows a foot to be easily inserted can be obtained.

(Fabric)

A fabric according to one or more embodiments of the present invention is used for a tongue-integrated upper of a shoe. The fabric comprises a tubular fabric element. The tubular fabric element comprises a first sock part and a second sock part. The first sock part comprises a first foot and a first leg. The second sock part comprises a second foot and a second leg. The first foot, the first leg, the second leg, and the second foot are continuously formed in this order. The central axis of the first leg and the central axis of the second leg do not coincide with each other and are not parallel to each other. The feature that the first foot, the first leg, the second leg, and the second foot are continuously formed in this order means that the first leg and the second leg are connected together so that the first sock part and the second sock part form a tubular structure.

The feature that the central axis of the first leg and the central axis of the second leg do not coincide with each other and are not parallel to each other is determined in a state in which the fabric used for the upper is laid flat such that a heel of the first sock part and a heel of the second sock part are respectively disposed at opposite lateral side ends on the upper side. It is preferable that the wording "the central axis of the first leg and the central axis of the second leg do not coincide with each other and are not parallel to each other" specifically means that, when the fabric is laid flat such that the heel of the first sock part and the heel of the second sock part are respectively disposed at opposite lateral side ends on the upper side, an upper end of a leg constituted by the first leg and the second leg has a curved portion protruding upward (hereinafter also referred to as a protrusion) or a curved portion depressed downward (hereinafter also referred to as a depression), and the apex (highest point) of the protrusion or the bottom point (lowest point) of the depression is on the boundary line (also referred to as a connecting line) between the first sock part and the second sock part. With this configuration, the heel side and the instep side of a wearing opening of an upper formed by placing the first sock part within the wall defining the second sock part at different levels, which improves the ease of putting on. In the upper formed by placing the first sock part within the wall defining the second sock part, the outer surface of the first sock part of the fabric for the upper becomes the surface that will face the foot of the wearer in use, while the inner surface of the first sock part of the fabric becomes the surface that faces the second sock part.

Alternatively, it is preferable that the wording "the central axis of the first leg and the central axis of the second leg do not coincide with each other and are not parallel to each other" specifically means that, when the fabric is laid flat such that the heel of the first sock part and the heel of the second sock part are respectively disposed at opposite lateral side ends on the upper side, a crease portion is formed in a lower portion of either or both of the first leg and the second leg near the boundary line between the first sock part and the second sock part. With this configuration, the wearing opening of the upper formed by placing the first sock part within the wall defining the second sock part has a curved portion (curved shape), which improves the ease of putting on and the fittability. In the upper formed by placing the first sock part within the wall defining the second sock part, the outer surface of the first sock part of the fabric for the upper becomes the surface that will face the foot of the wearer in use, while the inner surface of the first sock part of the fabric becomes the surface that faces the second sock part.

When the fabric is laid flat such that the heel of the first sock part and the heel of the second sock part are respectively disposed at opposite lateral side ends on the upper side, the length of an upper end of the first leg and the length of an upper end of the second leg may be the same or different. It is preferable that the length of the upper end of the first leg and the length of the upper end of the second leg are different, because this makes it easy to cause the first layer and the second layer to have different heights at the wearing opening. It is more preferable that the length of the upper end of the first leg is longer than the length of the upper end of the second leg, because this makes it easy to cause the first layer, which is to be disposed on the foot side, to be the higher.

The first foot may have a first opening in a tiptoe or near the plantar side thereof, and the second foot may have a second opening in a tiptoe or near the plantar side thereof. In addition, the first opening and/or the second opening may be closed through sewing or by using an adhesive or the like.

A circular knitted fabric that is knitted using a circular knitting machine, for example, a sock knitting machine or the like, can be used as the tubular fabric element. There is no particular limitation on the structure of the circular knitted fabric, and examples thereof include three basic weft knitted structures, a plain structure (jersey structure), a rib structure, and a purl structure, as well as modified structures such as a broad rib structure, a tuck structure, a float structure, a tuck mesh structure, an eyelet structure, and a jacquard mesh structure.

There is no particular limitation on fibers constituting the circular knitted fabric, and, for example, polyester fibers such as polyethylene terephthalate, polytrimethylene terephthalate, and polybutylene terephthalate, polyurethane fibers, polyamide fibers, acetate fibers, cotton fibers, rayon fibers, ethylene vinyl alcohol fibers, nylon fibers, and the like can be used.

The yarn used to make the circular knitted fabric may be a spun yarn, but is preferably a filament. The filament may be a monofilament or a multifilament. The yarn used to make the circular knitted fabric preferably contains a heat-fusible yarn because it is easy to form a heat-fusible yarn into a three-dimensional shape that conforms to the foot shape without using a reinforcing material. Any heat-fusible yarn (also referred to as hot-melt yarn) can be used as long as it contains heat-fusible fibers, and examples of the heat-fusible fibers include fibers containing at least one low-melting-point resin selected from the group consisting of polyester, polyamide, and polyolefin such as polypropylene. The heat-fusible fibers may be fibers each including a core and a sheath, the sheath being composed of a low-melting-point resin, and the core being composed of a thermoplastic resin having a higher melting point than the low-melting-point resin constituting the sheath. It is desirable that the heat-fusible yarn is fusion bonded at a temperature of 60° C. to 200° C., for example. The term "fusion bonded" as used herein means a state in which, at a contact portion between heat-fusible fibers, at least a portion of a fiber adheres to, or is fused and in close contact with, a portion of another fiber by heat, or heat and pressure, applied to the heat-fusible fibers.

The circular knitted fabric may contain an elastic yarn or a non-elastic yarn in addition to the heat-fusible yarn. The elastic yarn preferably has a breaking elongation of 20% or more, and more preferably 20% to 50%, for example. Although there is no particular limitation on the elastic yarn, examples thereof include elastic yarns constituted by polyurethane-based elastic fibers (also referred to as spandex fibers), polyether-ester-based elastic fibers, nylon fibers, and the like. The elastic yarn may be constituted only by elastic fibers, or may be a yarn obtained by combining elastic fibers with non-elastic fibers, which will be described later. The non-elastic yarn preferably has a breaking elongation of less than 20%, for example. Although there is no particular limitation on the non-elastic yarn, examples thereof include non-elastic yarns constituted by non-elastic fibers such as polyester-based fibers such as polyethylene terephthalate and polytrimethylene terephthalate fibers; polyamide-based fibers; polyolefin-based fibers such as polypropylene fibers; cellulosic fibers such as cuprammonium rayon, rayon, cotton, and bamboo fibers; and animal hair-based fibers such as wool fibers.

(Upper)

An upper according to one or more embodiments of the present invention is a tongue-integrated upper and comprises the fabric according to one or more embodiments of the present invention. The upper has a first layer formed of the first sock part and disposed on the foot side, and a second layer formed of the second sock part and disposed covering the first layer. The heel side and the instep side of the wearing opening formed near the boundary between the first leg and the second leg (also referred to as the boundary line between the first sock part and the second sock part) are not at the same horizontal level. The term "level" as used herein means the height from a horizontal plane as measured when the plantar side (bottom surface side) of the upper is placed on the horizontal plane. The upper may be manufactured by inserting the first sock part into the second sock part, i.e., moving the first sock part to be within the wall defining the second sock part. In the upper formed by moving the first sock part within the wall defining the second sock part, the outer surface of the first sock part of the fabric for the upper becomes the surface that will face the foot of the wearer in use, while the inner surface of the first sock part of the fabric becomes the surface that faces the second sock part.

Specifically, the first foot of the first sock part forms a forefoot and midfoot of the first layer of the upper, the second foot of the second sock part forms a forefoot and midfoot of the second layer of the upper. The first leg of the first sock part forms a hindfoot of the first layer of the upper, and the second leg of the second sock part forms a hindfoot of the second layer of the upper. The first opening of the first sock part and the second opening of the second sock part are located in a tiptoe of the upper or near the plantar side of the tiptoe, and may be sewn up as they are, or may be sewn up via an end fabric element.

The heel side of the wearing opening may be at a higher level than the instep side thereof. With this configuration, a shoe that is less likely to come off and also has improved ankle holding properties can be obtained. Alternatively, the instep side of the wearing opening may be at a higher level than the heel side thereof. With this configuration, a shoe that allows a foot to be easily inserted therein can be obtained. Furthermore, a top end of the wearing opening may have a curved shape (curved portion) in which the heel side and the instep side are at higher levels than the remaining portion. With this configuration, a shoe that is less likely to come off and also has improved ankle holding properties and fittability can be obtained. The lowest point of the curved portion (depression) is preferably located closer to the heel side (in other words, closer to the rear side), or closer to the instep side (in other words, closer to the front side). When the lowest point of the curved portion (depression) is located closer to the instep side, a shoe that is less likely to come off and also has improved supporting properties can be obtained. When the lowest point of the curved portion (depression) is located closer to the heel side, a shoe that is easy to put on can be obtained.

At the wearing opening, it is preferable that the first layer and the second layer both have a double structure. With this configuration, the wearing opening has a four-layer folded structure portion, and thus, the ankle holding properties are easily improved. In addition, when the boundary between the four-layer folded structure portion and a two-layer structure portion of the upper is positioned below the ankle, and a seam constituted by a sewing line is formed along the boundary, the ankle holding properties are easily improved even further.

At the wearing opening, a top end of the first layer and a top end of the second layer may be at the same horizontal level, but in order to obtain a smooth feel when putting on a shoe, it is preferable that the top end of the first layer is at a higher level than the top end of the second layer.

(Shoe)

In a shoe according to one or more embodiments of the present invention, the upper according to one or more embodiments of the present invention and a sole are formed as a single body. Thus, a shoe that has good contact between a foot and the shoe and with which both the ease of putting on and taking off and the supporting properties are easily achieved can be obtained. There is no particular limitation on the sole, and a sole for a shoe can be used as appropriate. There is also no particular limitation on the method for forming the upper and the sole as a single body, and, for example, the upper and the sole may be formed as a single body with use of an ordinary cemented construction method or the like.

Hereinafter, one or more embodiments of the present invention will be described in further detail based on the drawings. However, the present invention is not limited to the embodiments described below. In the drawings, like reference numerals denote like or corresponding parts, and repeated descriptions thereof will be omitted.

Figure 2:
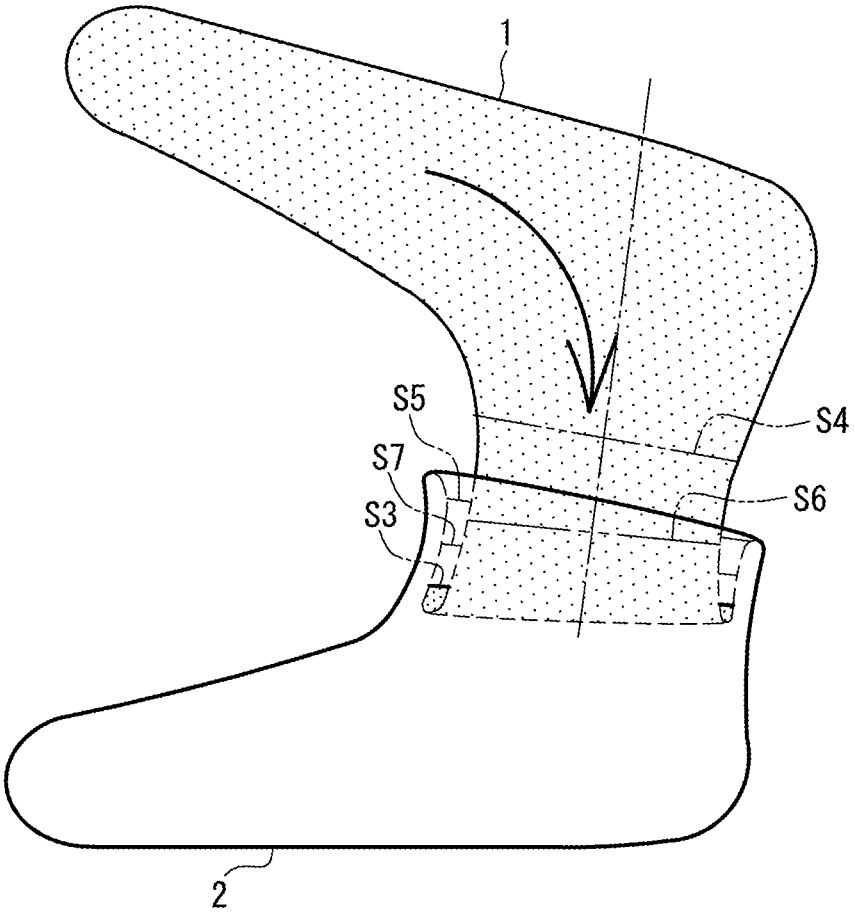
FIG. 2 is a schematic diagram illustrating a step of forming an upper using the fabric.
Figure 3:
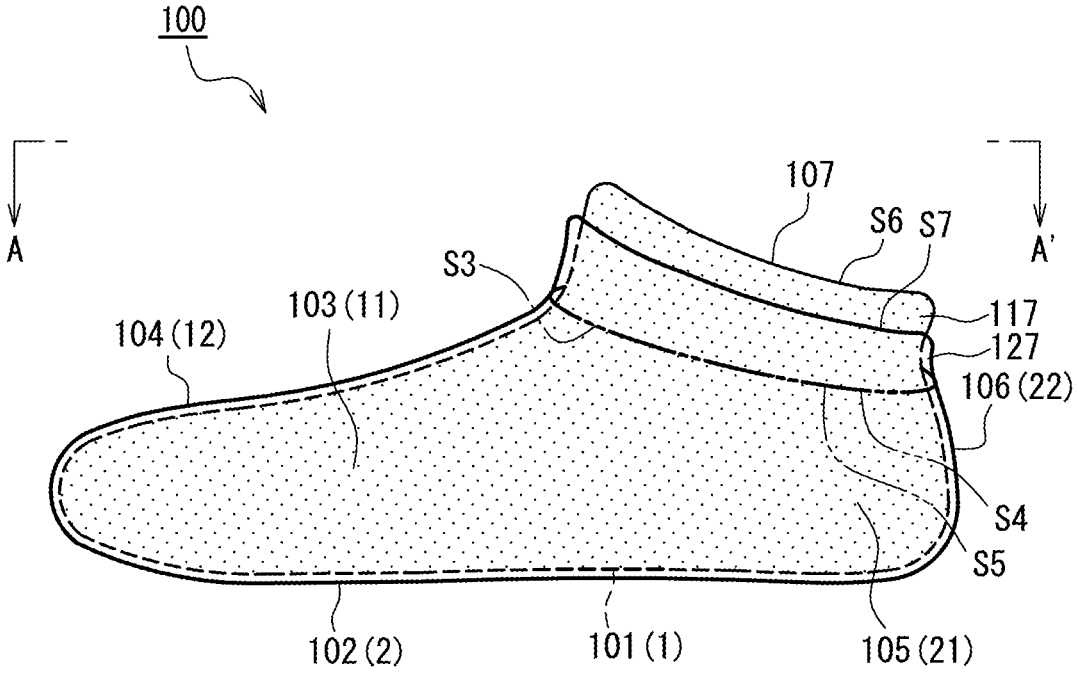
FIG. 3 is a schematic lateral side view of an upper (of a left foot) formed of the fabric.
Figure 4:
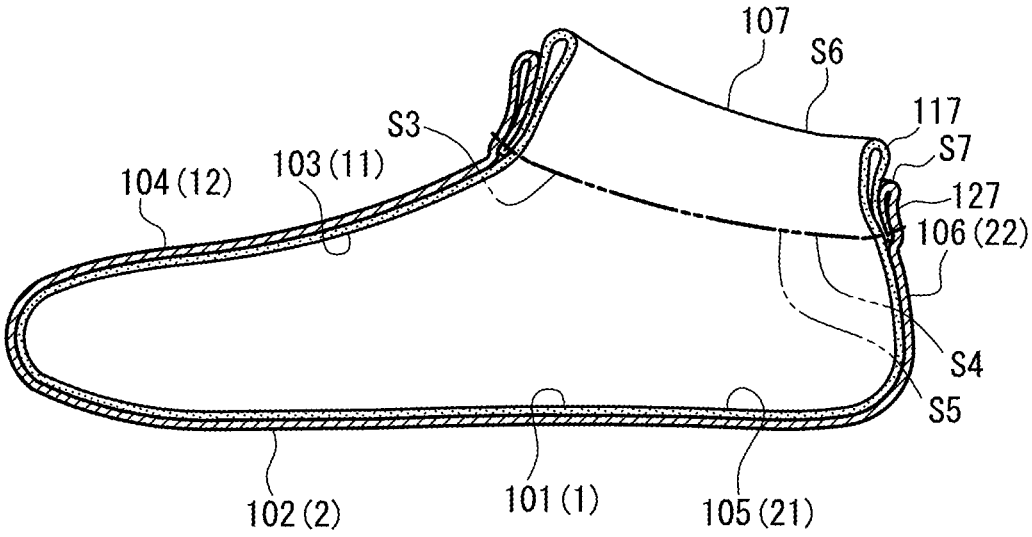
FIG. 4 is a schematic cross-sectional view of the upper taken along line A-A'.
Figure 5:
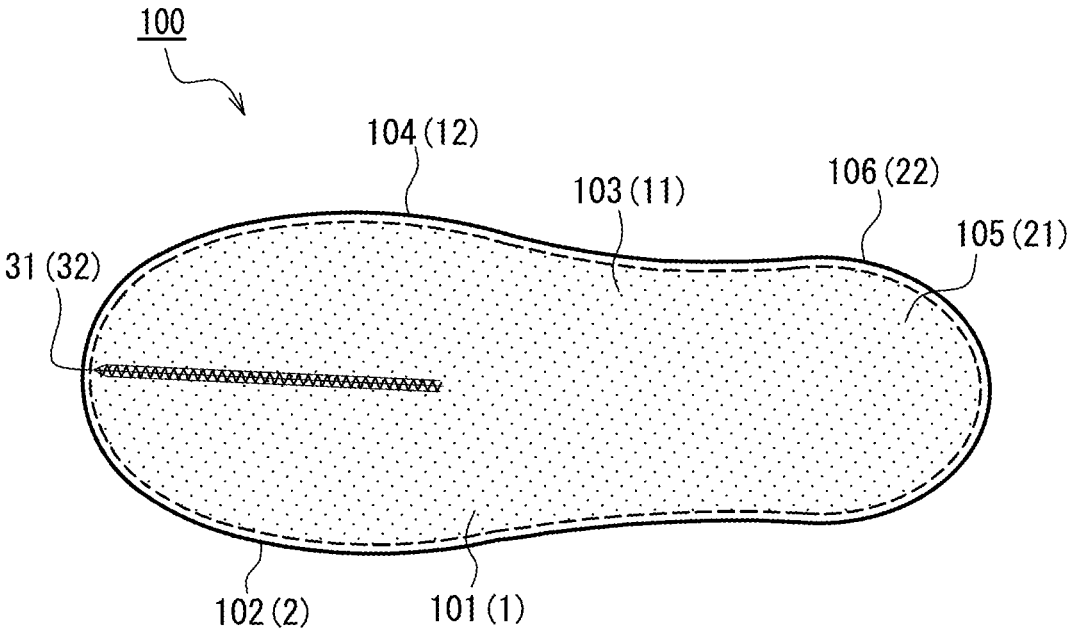
FIG. 5 is a schematic bottom view of the upper.
Figure 6:
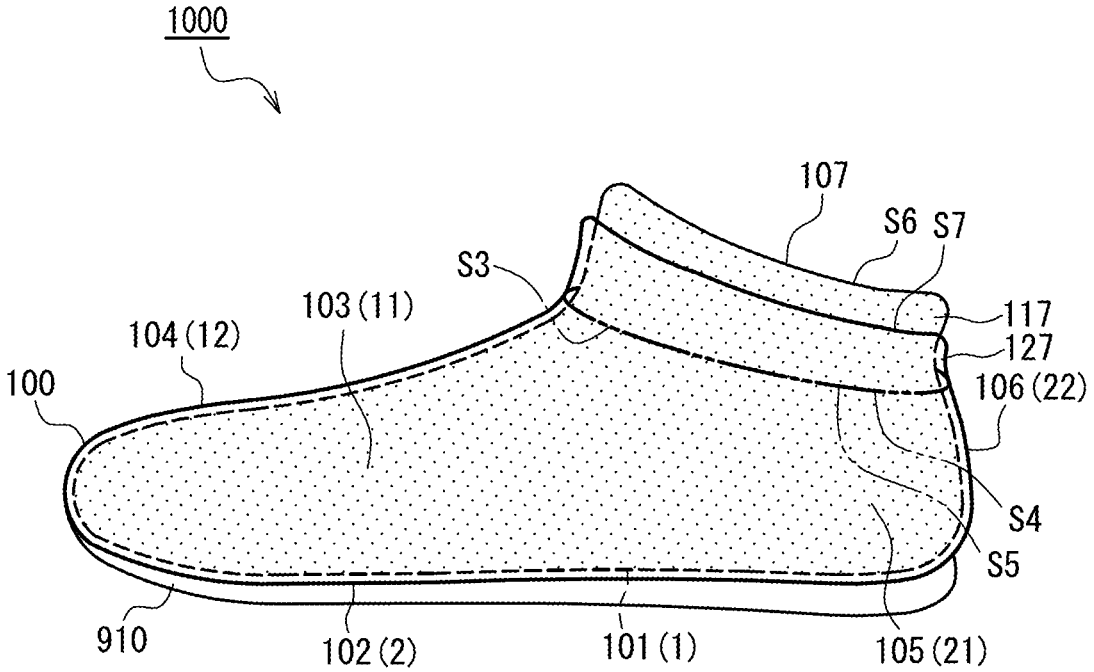
FIG. 6 is a schematic lateral side view of a shoe (of a left foot) using the upper.

FIG. 1 is a schematic view showing a state in which a fabric according to an embodiment of the present invention is laid flat such that a heel of a first sock part and a heel of a second sock part are respectively disposed at opposite lateral side ends on the upper side. FIG. 2 is a schematic diagram illustrating a step of forming an upper using the fabric. FIG. 3 is a schematic side view of an upper formed of the fabric, FIG. 4 is a schematic cross-sectional view of the upper taken along line A-A', and FIG. 5 is a schematic bottom view of the upper. FIG. 6 is a schematic lateral side view of a shoe (of a left foot) using the upper.

A fabric 10 of this embodiment comprises a tubular fabric element 20, and the tubular fabric element 20 comprises a first sock part 1 and a second sock part 2. The first sock part 1 comprises a first foot 11 and a first leg 21. The second sock part 2 comprises a second foot 12 and a second leg 22. The first foot part 11, the first leg 21, the second leg 22, and the second foot 12 are continuously formed in this order. The central axis S1 of the first leg 21 and the central axis S2 of the second leg 22 do not coincide with each other and are not parallel to each other. The first foot 11 has a first opening 31 on the plantar side near a tiptoe. The second foot 12 has a second opening 32 on the plantar side near a tiptoe. In this embodiment, the second opening 32 is closed through sewing.

As shown in FIG. 1, when the fabric 10 of this embodiment is laid flat such that a heel 23 of the first sock part 1 and a heel 24 of the second sock part 2 are respectively disposed at opposite lateral side ends on the upper side, an upper end of a leg constituted by the first leg 21 and the second 22 has a curved portion protruding downward, that is, a depression 3, and the bottom point of the depression 3 is on the boundary line S3 between the first sock part 1 and the second sock part 2. The depression 3 may have a pointed shape or a rounded shape. The length L1 of an upper end of the first leg 21 is longer than the length L2 of an upper end of the second leg 22.

As shown in FIG. 2, along the boundary line S3 between the first sock part 1 and the second sock part 2, the first sock part 1 is moved into the second sock part 2, i.e., the first sock part 1 is moved to be within the wall defining the second sock part 2. Thus, as shown in FIG. 3, a tongue-integrated upper 100 including a first layer 101 formed of the first sock part 1 and disposed on the foot side and a second layer 102 formed of the second sock part 2 and disposed covering the first layer can be obtained. The outer surface of the first sock part 1 of the fabric for the upper becomes the surface that will face the foot of the wearer in use, while the inner surface of the first sock part 1 of the fabric becomes the surface that faces the second sock part 2. Specifically, the first foot 11 of the first sock part forms a forefoot and midfoot 103 of the first layer of the upper 100, the second foot 12 of the second sock part forms a forefoot and midfoot 104 of the second layer of the upper 100, the first leg 21 of the first sock part forms a hindfoot 105 of the first layer of the upper 100, and the second leg 22 of the second sock part forms a hindfoot 106 of the second layer of the upper 100. In the upper 100, a wearing opening 107 has a front-rear sloping structure with the instep side being at a higher level than the heel side, which makes it easy to insert a foot into a shoe.

A configuration is adopted in which the boundary line S3 between the first sock part 1 and the second sock part 2 coincides with an ankle line S4 of the first sock part and an ankle line S5 of the second sock part, and a wearing opening top end line S6 of the first sock part and a wearing opening top end line S7 of the second sock part coincide with a wearing opening top end line of the first layer and a wearing opening top end line of the second layer, respectively. With this configuration, as shown in FIG. 4, the first layer and the second layer both have a double structure portion at the wearing opening 107, and accordingly, the wearing opening 107 has a four-layer folded structure. The boundary (S3, S4, and S5) between the four-layer folded structure and a two-layer structure is located below the ankle, and thus, the ankle holding properties are easily improved even further. If necessary, a seam constituted by a sewing line may be formed along the boundary between the four-layer folded structure and the two-layer structure.

The central axis S1 of the first leg 21 and the central axis S2 of the second leg 22 do not coincide with each other and are not parallel to each other, and thus, the heel side and the instep side of the wearing opening 107 are at different levels. In addition, in this embodiment, the fabric 10 in which the length L1 of the upper end of the first leg 21 is longer than the length L2 of the upper end of the second leg is used, and thus, at the wearing opening 107, the position of a top end of the first layer 117 is at a higher level than the position of a top end of the second layer 127.

As shown in FIG. 5, the opening 31 of the first sock part 1 and the opening 32 of the second sock part 2 are located on the plantar side near a tiptoe of the upper 100, and may be sewn up as they are. Then, the upper 100 can be shaped by putting the upper 100 on a foot mold of a predetermined shape and performing heat treatment at a temperature at which the heat-fusible yarn contained in the fabric 10 forming the upper 100 is fusion-bonded, for example, at a temperature of 60° C. to 200° C.

As shown in FIG. 6, a shoe 1000 includes the upper 100 and a sole 910, and the upper 100 and the sole 910 are formed as a single body.

Figure 7:
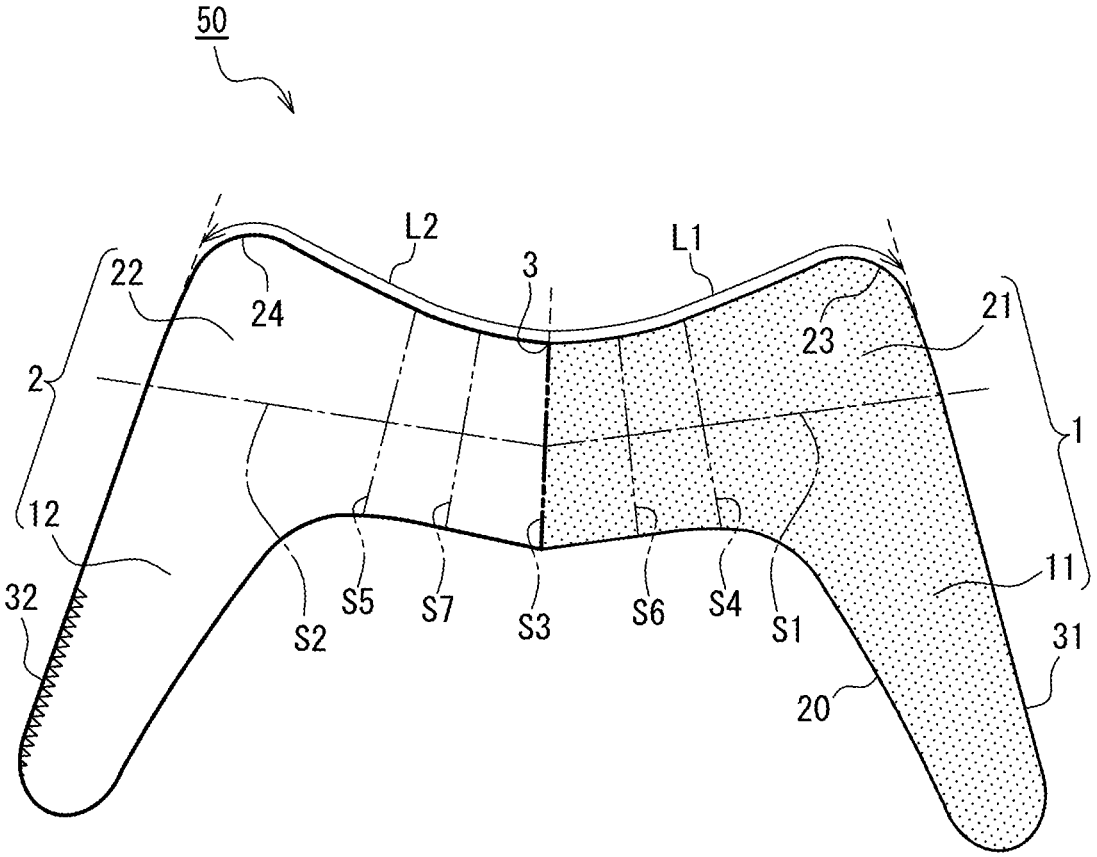
FIG. 7 is a schematic view showing a state in which a fabric according to an embodiment of the present invention is laid flat such that a heel of a first sock part and a heel of a second sock part are respectively disposed at opposite lateral side ends on the upper side.
Figure 8:
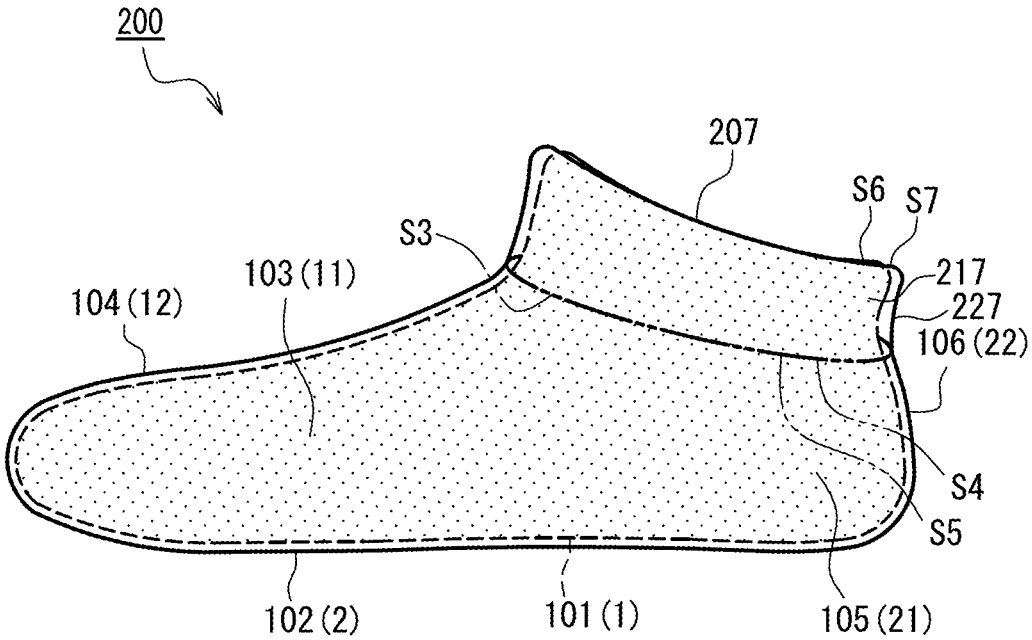
FIG. 8 is a schematic side view of an upper formed of the fabric.
Figure 9:
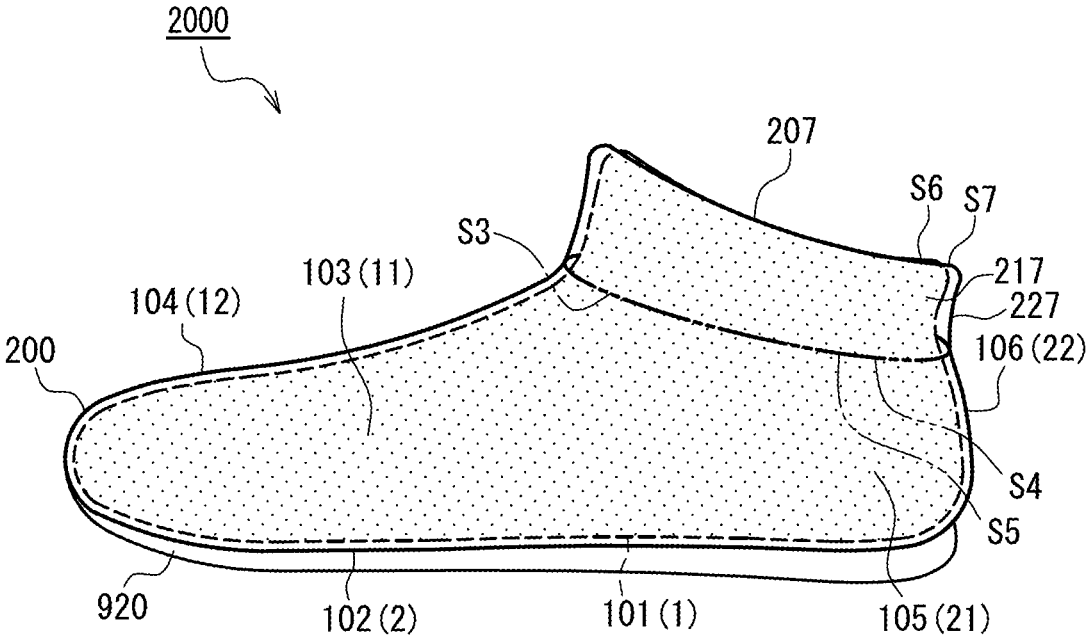
FIG. 9 is a schematic lateral side view of a shoe (of a left foot) using the upper.

FIG. 7 is a schematic view showing a state in which a fabric according to an embodiment of the present invention is laid flat such that the heel 23 of the first sock part and the heel 24 of the second sock part are respectively disposed at opposite lateral side ends on the upper side. FIG. 8 is a schematic side view of an upper formed of the fabric. FIG. 9 is a schematic lateral side view of a shoe (of a left foot) using the upper. As shown in FIG. 7, a fabric 50 of this embodiment has a configuration similar to that of the fabric 10, except that the length L1 of the upper end of the first leg 21 and the length L2 of the upper end of the second leg 22 are the same. An upper 200 that is formed using the fabric 50 by moving the first sock part 1 into the second sock part 2 along the boundary line S3 between the first sock part 1 and the second sock part 2, i.e., by moving the first sock part 1 to be within the wall defining the second sock part 2 along the boundary line S3 between the first sock part 1 and the second sock part 2, like the fabric 10, has a configuration similar to that of the upper 100, except that the top end of a first layer 217 and the top end of a second layer 227 at a wearing opening 207 are at the same level, as shown in FIG. 8. The outer surface of the first sock part 1 of the fabric for the upper becomes the surface that will face the foot of the wearer in use, while the inner surface of the first sock part 1 of the fabric becomes the surface that faces the second sock part 2. As shown in FIG. 9, a shoe 2000 includes the upper 200 and a sole 920, and the upper 200 and the sole 920 are formed as a single body.

Figure 10:
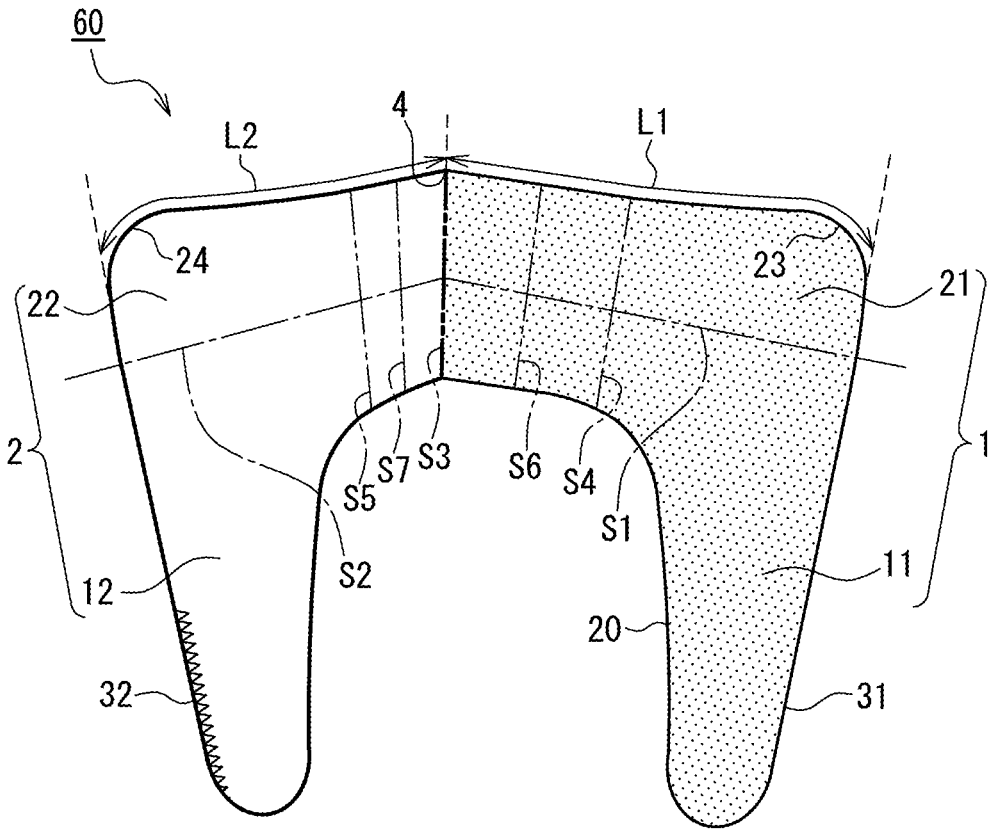
FIG. 10 is a schematic view showing a state in which a fabric according to an embodiment of the present invention is laid flat such that a heel of a first sock part and a heel of a second sock part are respectively disposed at opposite lateral side ends on the upper side.
Figure 11:
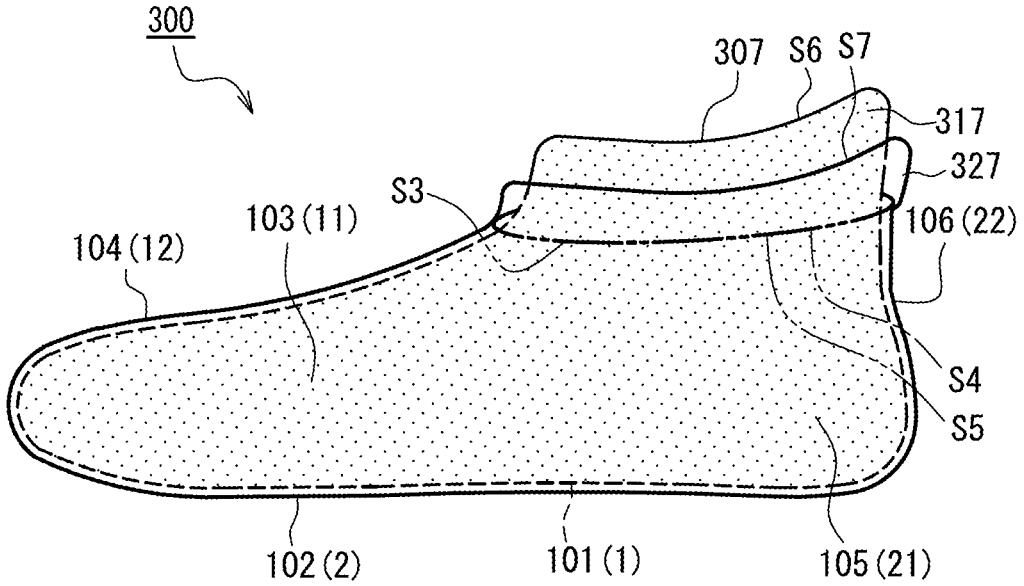
FIG. 11 is a schematic side view of an upper formed of the fabric.
Figure 12:
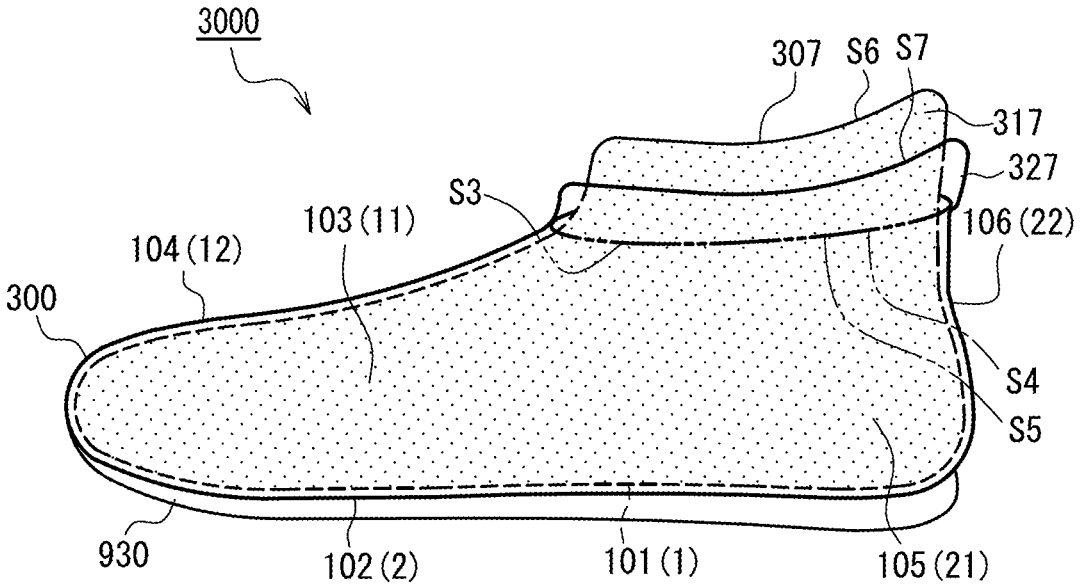
FIG. 12 is a schematic lateral side view of a shoe (of a left foot) using the upper.

FIG. 10 is a schematic view showing a state in which a fabric according to an embodiment of the present invention is laid flat such that the heel 23 of the first sock part and the heel 24 of the second sock part are respectively disposed at opposite lateral side ends on the upper side. FIG. 11 is a schematic side view of an upper formed of the fabric. FIG. 12 is a schematic lateral side view of a shoe (of a left foot) using the upper. As shown in FIG. 10, a fabric 60 of this embodiment has a configuration similar to that of the fabric 10, except that the upper ends of the leg constituted by the first leg 21 and the second leg 22 have a protrusion 4 protruding upward, and the apex of the protrusion 4 is on the boundary line S3 between the first sock part 1 and the second sock part 2. The protrusion 4 may have a pointed shape or a rounded shape. An upper 300 that is formed using the fabric 60 by inserting the first sock part 1 into the second sock part 2 along the boundary line S3 between the first sock part 1 and the second sock part 2, i.e., by moving the first sock part 1 to be within the wall defining the second sock part 2 along the boundary line S3 between the first sock part 1 and the second sock part 2, like the fabric 10, has a configuration similar to that of the upper 100, except that a wearing opening 307 has a front-rear sloping structure with the heel side being at a higher level than an instep side, as shown in FIG. 11. This wearing opening 307, with the heel side being at a higher level than the instep side, makes it possible to obtain a shoe that is less likely to come off and that also has improved ankle holding properties. At the wearing opening 307, the position of the top end of a first layer 317 is at a higher level than the position of the top end of a second layer 327. The outer surface of the first sock part 1 of the fabric for the upper becomes the surface that will face the foot of the wearer in use, while the inner surface of the first sock part 1 of the fabric becomes the surface that faces the second sock part 2. As shown in FIG. 12, a shoe 3000 includes the upper 300 and a sole 930, and the upper 300 and the sole 930 are formed as a single body.

Figure 13:
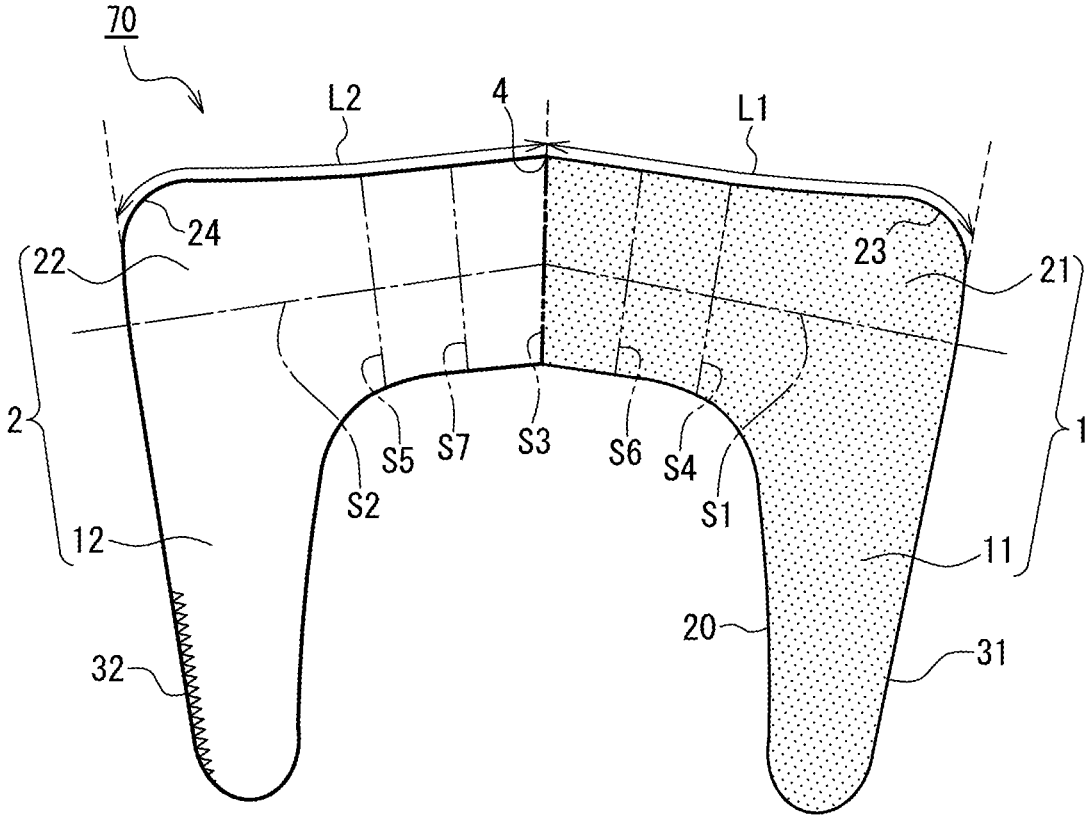
FIG. 13 is a schematic view showing a state in which a fabric according to an embodiment of the present invention is laid flat such that a heel of a first sock part and a heel of a second sock part are respectively disposed at opposite lateral side ends on the upper side.
Figure 14:
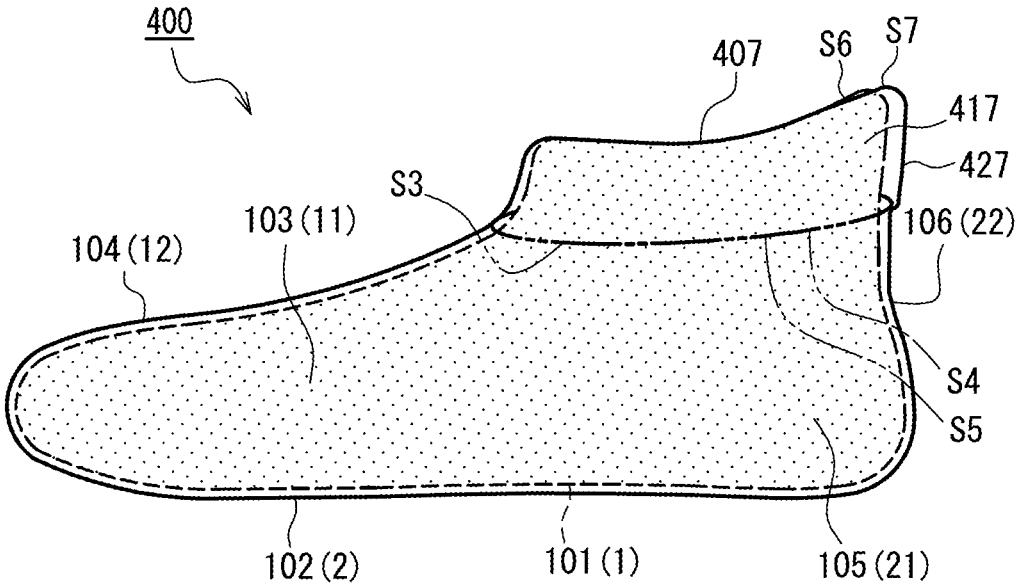
FIG. 14 is a schematic side view of an upper formed of the fabric.
Figure 15:
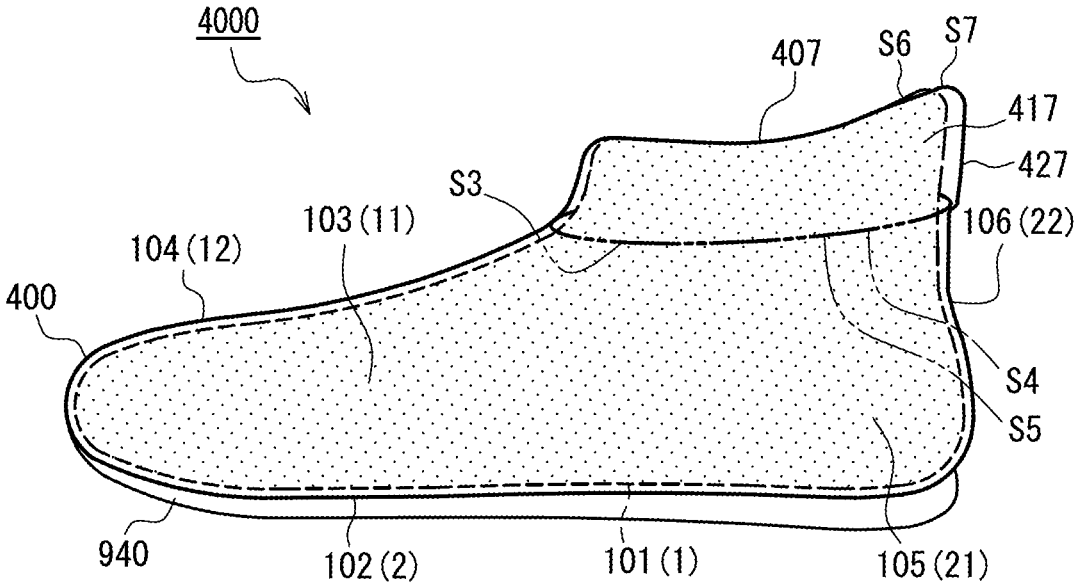
FIG. 15 is a schematic lateral side view of a shoe (of a left foot) using the upper.

FIG. 13 is a schematic view showing a state in which a fabric according to an embodiment of the present invention is laid flat such that the heel 23 of the first sock part and the heel 24 of the second sock part are respectively disposed at opposite lateral side ends on the upper side. FIG. 14 is a schematic side view of an upper formed of the fabric. FIG. 15 is a schematic lateral side view of a shoe (of a left foot) using the upper. As shown in FIG. 13, a fabric 70 of this embodiment has a configuration similar to that of the fabric 10, except that the upper ends of the leg constituted by the first leg part 21 and the second leg part 22 have a protrusion 4 protruding upward, the apex of the protrusion 4 is on the boundary line S3 between the first sock part 1 and the second sock part 2, and the length L1 of the upper end of the first leg 21 and the length L2 of the upper end of the second leg 22 are the same. The protrusion 4 may have a pointed shape or a rounded shape. An upper 400 that is formed using the fabric 70 by inserting the first sock part 1 into the second sock part 2 along the boundary line S3 between the first sock part 1 and the second sock part 2, i.e., by moving the first sock part 1 to be within the wall defining the second sock part 2 along the boundary line S3 between the first sock part 1 and the second sock part 2, like the fabric 10, has a configuration similar to that of the upper 100, except that a wearing opening 407 has a front-rear sloping structure with the heel side being at a higher level than the instep side, and the top end of a first layer 417 and the top end of a second layer 427 at the wearing opening 407 are at the same level, as shown in FIG. 14. This wearing opening 407, with the heel side being at a higher level than the instep side, makes it possible to obtain a shoe that is less likely to come off and that also has improved ankle holding properties. The outer surface of the first sock part 1 of the fabric for the upper becomes the surface that will face the foot of the wearer in use, while the inner surface of the first sock part 1 of the fabric becomes the surface that faces the second sock part 2. As shown in FIG. 15, a shoe 4000 includes the upper 400 and a sole 940, and the upper 400 and the sole 940 are formed as a single body.

Figure 16:
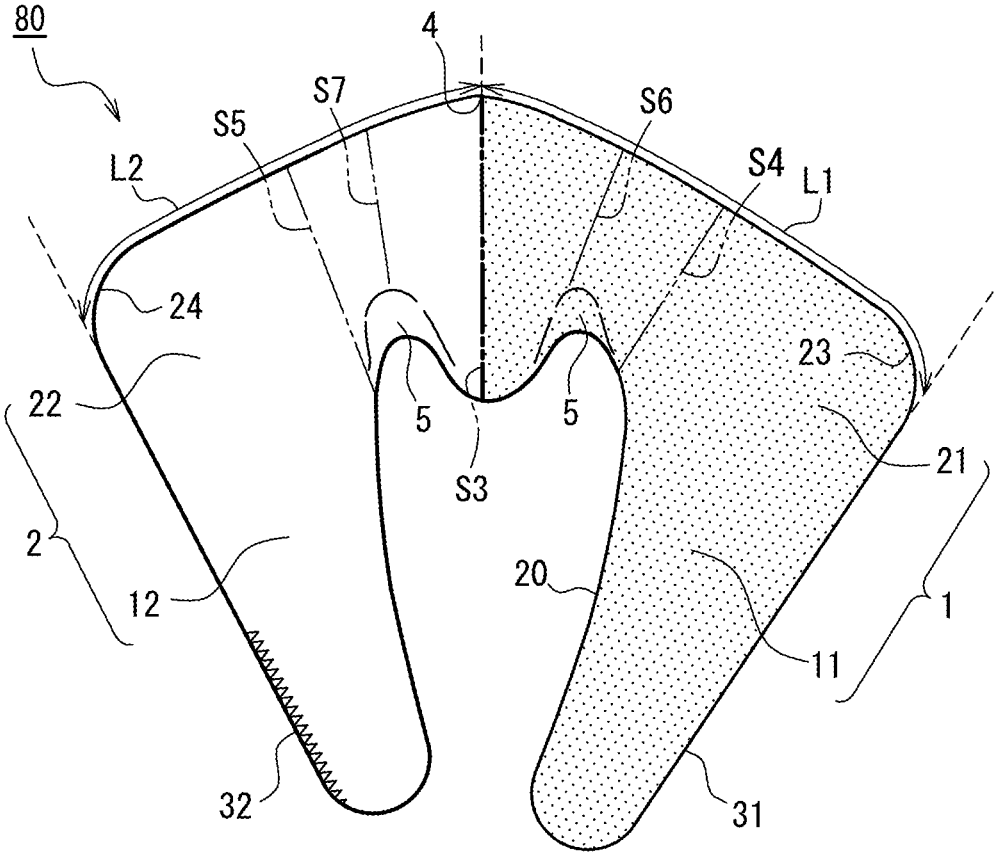
FIG. 16 is a schematic view showing a state in which a fabric according to an embodiment of the present invention is laid flat such that a heel of a first sock part and a heel of a second sock part are respectively disposed at opposite lateral side ends on the upper side.
Figure 17:
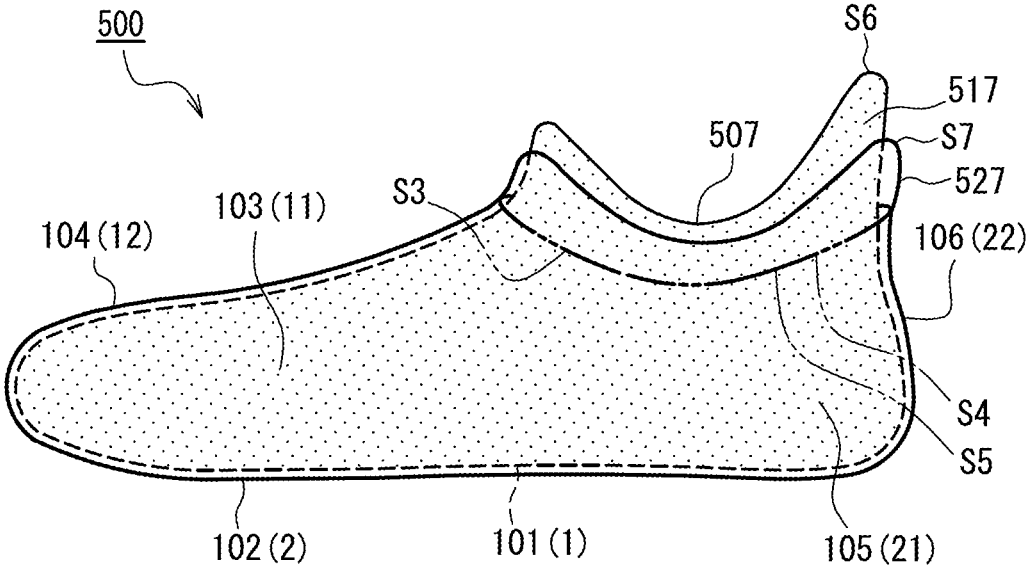
FIG. 17 is a schematic side view of an upper formed of the fabric.
Figure 18:
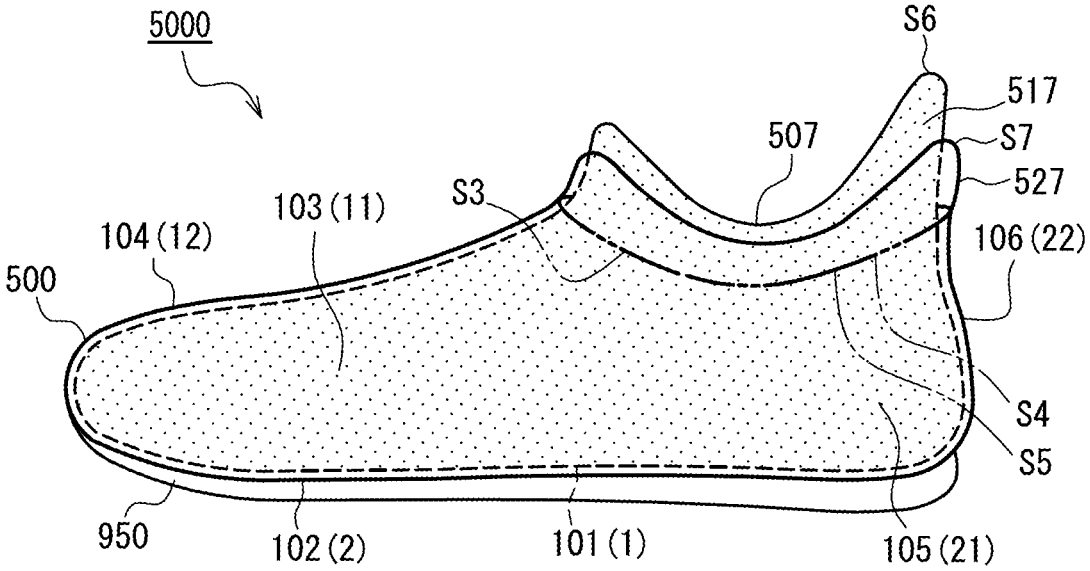
FIG. 18 is a schematic lateral side view of a shoe (of a left foot) using the upper.

FIG. 16 is a schematic view showing a state in which a fabric according to an embodiment of the present invention is laid flat such that the heel 23 of the first sock part and the heel 24 of the second sock part are respectively disposed at opposite lateral side ends on the upper side. FIG. 17 is a schematic side view of an upper formed of the fabric. FIG. 18 is a schematic lateral side view of a shoe (of a left foot) using the upper. As shown in FIG. 16, a fabric 80 of this embodiment has a configuration similar to that of the fabric 10, except that the upper ends of the leg constituted by the first leg part 21 and the second leg part 22 have a protrusion 4 protruding upward, the apex of the protrusion 4 is on the boundary line S3 between the first sock part 1 and the second sock part 2, and crease portions 5 are formed in lower portions of both the first leg and the second leg near the boundary line S3 between the first sock part 1 and the second sock part 2. An upper 500 that is formed using the fabric 80 by inserting the first sock part 1 into the second sock part 2 along the boundary line S3 between the first sock part 1 and the second sock part 2, i.e., by moving the first sock part 1 to be within the wall defining the second sock part 2 along the boundary line S3 between the first sock part 1 and the second sock part 2, like the fabric 10, has a configuration similar to that of the upper 100, except that a wearing opening 507 has a curve shape (curved portion) in which the heel side and the instep side are at higher levels than the remaining portion (center portion), as shown in FIG. 17. Having the curved shape, the wearing opening 507 makes it possible to obtain a shoe that is less likely to come off and that also has improved ankle holding properties and fittability. At the wearing opening 507, the position of the top end of a first layer 517 is at a higher level than the position of the top end of a second layer 527. The outer surface of the first sock part 1 of the fabric for the upper becomes the surface that will face the foot of the wearer in use, while the inner surface of the first sock part 1 of the fabric becomes the surface that faces the second sock part 2. As shown in FIG. 18, a shoe 5000 includes the upper 500 and a sole 950, and the upper 500 and the sole 950 are formed as a single body.

The fabric according to one or more embodiments of the present invention is used for a tongue-integrated upper, an upper using the fabric can be suitably used as an upper of a sports shoe such as a running shoe, and a shoe using the upper can be suitably used as a sports shoe such as a running shoe.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A fabric configured to be used for a tongue-integrated upper of a shoe, wherein the fabric comprises a tubular fabric element, and the tubular fabric element comprises a first sock part and a second sock part, the first sock part comprises a first foot and a first leg, the second sock part comprises a second foot and a second leg, and the first foot, the first leg, the second leg, and the second foot are continuously formed in this order, a central axis of the first leg and a central axis of the second leg do not coincide with each other and are not parallel to each other, when a shoe upper is formed from the fabric, the first sock part is moved to be within the wall defining the second sock part, the first sock part forms a first layer disposed on a foot side of an upper, and the second sock part forms a second layer disposed to cover the first layer, and when the fabric is laid flat such that a heel of the first sock part and a heel of the second sock part are respectively disposed at opposite lateral side ends on an upper side, a length of an upper end of the first leg is longer than a length of an upper end of the second leg.

2. The fabric configured to be used for a shoe upper according to claim 1, wherein, when the fabric is laid flat such that a heel of the first sock part and a heel of the second sock part are respectively disposed at opposite lateral side ends on an upper side, an upper end of a leg constituted by the first leg and the second leg has a protrusion protruding upward or a depression protruding downward, and an apex of the protrusion or a bottom point of the depression is on a boundary line between the first sock part and the second sock part.

3. The fabric configured to be used for a shoe upper according to claim 1, wherein the first foot has a first opening in a tiptoe or near a plantar side thereof, the second foot has a second opening in a tiptoe or near a plantar side thereof, and the first opening and/or the second opening is closed through sewing.

4. A shoe upper comprising the fabric configured to be used for a shoe upper according to claim 1, wherein the upper comprises a first layer formed of the first sock part and disposed on a foot side and a second layer formed of the second sock part and disposed covering the first layer, and at a wearing opening formed near a boundary line between the first leg and the second leg, a heel side, an instep side, and a portion between the heel side and the instep side of a top end of the first layer are all at a higher level than a heel side, an instep side, and a portion between the heel side and the instep side of a top end of the second layer.

5. The shoe upper according to claim 4, wherein a top end of the wearing opening has a curved shape in which the heel side and the instep side are at higher levels than a remaining portion.

6. The shoe upper according to claim 5, wherein, a difference in vertical level between the top end of the first layer and the top end of the second layer is larger in the heel side and/or the instep side than in a portion between the heel side and the instep side of the wearing opening.

7. The shoe upper according to claim 4, wherein the wearing opening has a four-layer folded portion formed by a double structure portion of the first leg and a double structure portion of the second leg.

8. The shoe upper according to claim 4, wherein, when the fabric is laid flat such that a heel of the first sock part and a heel of the second sock part are respectively disposed at opposite lateral side ends on an upper side, an upper end of a leg constituted by the first leg and the second leg has a protrusion protruding upward or a depression protruding downward, and an apex of the protrusion or a bottom point of the depression is on a boundary line between the first sock part and the second sock part.

9. The shoe upper according to claim 4, wherein, when the fabric is laid flat such that a heel of the first sock part and a heel of the second sock part are respectively disposed at opposite lateral side ends on an upper side, an upper end of the first leg and an upper end of the second leg have different lengths.

10. The shoe upper according to claim 4, wherein the first foot has a first opening in a tiptoe or near a plantar side thereof, the second foot has a second opening in a tiptoe or near a plantar side thereof, and the first opening and/or the second opening is closed through sewing.

11. A shoe in which the shoe upper according to claim 4 and a sole are formed as a single body.

12. The shoe according to claim 11, wherein a top end of the wearing opening has a curved shape in which the heel side and the instep side are at higher levels than a remaining portion.

13. The shoe according to claim 11, wherein the wearing opening has a four-layer folded portion formed by a double structure portion of the first leg and a double structure portion of the second leg.

14. The shoe according to claim 11, wherein, when the fabric is laid flat such that a heel of the first sock part and a heel of the second sock part are respectively disposed at opposite lateral side ends on an upper side, an upper end of a leg constituted by the first leg and the second leg has a protrusion protruding upward or a depression protruding downward, and an apex of the protrusion or a bottom point of the depression is on a boundary line between the first sock part and the second sock part.

15. The shoe according to claim 11, wherein the first foot has a first opening in a tiptoe or near a plantar side thereof, the second foot has a second opening in a tiptoe or near a plantar side thereof, and the first opening and/or the second opening is closed through sewing.

16. The fabric configured to be used for a shoe upper according to claim 1, wherein when the fabric is laid flat such that a heel of the first sock part and a heel of the second sock part are respectively disposed at opposite lateral side ends on an upper side, a crease portion is formed in a lower portion of either or both of the first leg and the second leg near a boundary line between the first sock part and the second sock part.

17. A method for producing a shoe upper using the fabric configured to be used for a shoe upper according to claim 1, comprising: moving the first sock part to be within the wall defining the second sock part.

* * * * *